US010937372B2

(12) United States Patent
An et al.

(10) Patent No.: US 10,937,372 B2
(45) Date of Patent: Mar. 2, 2021

(54) SPOT COMPENSATING APPARATUS, METHOD OF COMPENSATING SPOT USING THE SAME, AND DISPLAY SYSTEM HAVING THE SAME

(71) Applicant: Samsung Display Co., Ltd., Yongin-si (KR)

(72) Inventors: Byoung-Kwan An, Suwon-si (KR); Seung-Ho Park, Suwon-si (KR); Hee-Sook Park, Siheung-si (KR); Ji-Hye Eom, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 262 days.

(21) Appl. No.: 15/163,583

(22) Filed: May 24, 2016

(65) Prior Publication Data

US 2017/0206842 A1 Jul. 20, 2017

(30) Foreign Application Priority Data

Jan. 20, 2016 (KR) ..... 10-2016-0006925

(51) Int. Cl.
*G09G 3/3291* (2016.01)

(52) U.S. Cl.
CPC ..... *G09G 3/3291* (2013.01); *G09G 2310/08* (2013.01); *G09G 2320/0242* (2013.01); *G09G 2320/0266* (2013.01)

(58) Field of Classification Search
CPC .. G09G 5/06; G09G 2320/0285; G09G 3/006; G09G 2320/00–106; G09G 2360/14–148; G09G 3/3648; G09G 2320/0626; G09G 2320/0276; G09G 2320/0673; G09G 2320/0233; G09G 2330/10; G09G 3/3233–325; G09G 3/3283; G09G 3/3291; G09G 2360/145–148; G09G 2300/0852; G09G 2310/08; G09G 2320/02–0295
USPC ..... 345/601, 602, 207, 690
See application file for complete search history.

(56) References Cited

U.S. PATENT DOCUMENTS 6,621,498 B1 * 9/2003 Handley ..... H04N 1/6019 345/601
7,639,258 B1 * 12/2009 Dowling ..... G06T 11/203 345/441
2005/0057472 A1 * 3/2005 Lee ..... G09G 3/2092 345/89

(Continued)

FOREIGN PATENT DOCUMENTS

KR 10-2008-0001495 A 1/2008

*Primary Examiner* — Amr A Awad
*Assistant Examiner* — Aaron Midkiff
(74) *Attorney, Agent, or Firm* — Lewis Roca Rothgerber Christie LLP

(57) ABSTRACT

A spot compensating apparatus including a spot compensation data generator configured to generate spot compensation data based on a first precision unit in a first block area having a spot, and based on a second precision unit in a second block area not having the spot, the spot compensation data being for compensating the spot displayed on a display panel configured to display an image based on first image data, the second precision unit having less precision than the first precision unit, and a spot compensator configured to perform a spot compensation on the first image data using the spot compensation data to output second image data.

20 Claims, 10 Drawing Sheets

(56) References Cited

U.S. PATENT DOCUMENTS

| | | | | |
|---|---|---|---|---|
| 2008/0192039 | A1* | 8/2008 | Zhao | G09G 3/3648 345/206 |
| 2013/0265323 | A1* | 10/2013 | Morikawa | G09G 5/06 345/601 |
| 2014/0146090 | A1* | 5/2014 | Oh | G09G 3/20 345/690 |
| 2016/0267842 | A1* | 9/2016 | Zhang | G09G 3/3233 |
| 2017/0132979 | A1* | 5/2017 | Oh | G09G 3/3275 |

* cited by examiner

FIG. 5

| | DBL | | | | BLA3 | | | BLA4 | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 | 32 | 33 |
| 1 | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 | 32 |
| 2 | 33 | 34 | 35 | | | | | | | | | | | | | | | | | | | | | | | | | | | 62 | 63 | 64 | 65 |
| 3 | 66 | 67 | 68 | | | | | | | | | | | | | | | | | | | | | | | | | | | 95 | 96 | 97 | 98 |
| 4 | 99 | 100 | 101 | | | | | | | | | | | | | | | | | | | | | | | | | | | 128 | 129 | 130 | 131 |
| 5 | 132 | 133 | 134 | | | | | | | | | | | | | | | | | | | | | | | | | | | 161 | 162 | 163 | 164 |
| 6 | 165 | 166 | 167 | | | | | | | | | | | | | | | | | | | | | | | | | | | 194 | 195 | 196 | 197 |
| 7 | 198 | 199 | 200 | | | | | | | | | | | | | | | | | | | | | | | | | | | 227 | 228 | 229 | 230 |
| 8 | 231 | 232 | 233 | | | | | | | | | | | | | | | | | | | | | | | | | | | 260 | 261 | 262 | 263 |
| 9 | 264 | 265 | 266 | | | | | | | | | | | | | | | | | | | | | | | | | | | 293 | 294 | 295 | 296 |
| 10 | 297 | 298 | 299 | | | | | | | | | | | | | | | | | | | | | | | | | | | 326 | 327 | 328 | 329 |
| 11 | 330 | 331 | 332 | | | | | | | | | | | | | | | | | | | | | | | | | | | 359 | 360 | 361 | 362 |
| 12 | 363 | 364 | 365 | | | | | | | | | | | | | | | | | | | | | | | | | | | 392 | 393 | 394 | 395 |
| 13 | 396 | 397 | 398 | | | | | | | | | | | | | | | | | | | | | | | | | | | 425 | 426 | 427 | 428 |
| 14 | 429 | 430 | 431 | | | | | | | | | | | | | | | | | | | | | | | | | | | 448 | 449 | 450 | 461 |
| 15 | 462 | 463 | 464 | | | | | | | | | | | | | | | | | | | | | | | | | | | 491 | 492 | 493 | 494 |
| 16 | 495 | 496 | 497 | | | | | | | | | | | | | | | | | | | | | | | | | | | 524 | 525 | 526 | 527 |
| 17 | 528 | 529 | 530 | | | | | | | | | | | | | | | | | | | | | | | | | | | 557 | 558 | 559 | 560 |
| 18 | 561 | 562 | 563 | | | | | | | | | | | | | | | | | | | | | | | | | | | 590 | 591 | 592 | 593 |
| 19 | 594 | 595 | 596 | 597 | 598 | 599 | 600 | 601 | 602 | 603 | 604 | 605 | 606 | 607 | 608 | 609 | 610 | 611 | 612 | 613 | 614 | 615 | 616 | 617 | 618 | 619 | 620 | 621 | 622 | 623 | 624 | 625 | 626 |

SPOT COMPENSATING APPARATUS, METHOD OF COMPENSATING SPOT USING THE SAME, AND DISPLAY SYSTEM HAVING THE SAME

CROSS-REFERENCE TO RELATED APPLICATION

This application claims priority to and the benefit of Korean Patent Application No. 10-2016-0006925, filed on Jan. 20, 2016 in the Korean Intellectual Property Office (KIPO), the content of which is herein incorporated by reference in its entirety.

BACKGROUND

1. Field

Aspects of the present inventive concept relate to a display apparatus.

2. Description of the Related Art

A display apparatus includes a display panel and a display panel driving apparatus. The display panel displays images, and the display panel driving apparatus drives the display panel.

In some instances, one or more spots may appear on the display panel, which decrease the display quality of the display apparatus. Thus, it is desirable to compensate for the presence of the one or more spots.

SUMMARY

Aspects of embodiments of the present inventive concept are directed to a spot compensating apparatus capable of increasing precision of a spot compensation and decreasing a size of spot compensation data.

Aspects of embodiments of the present inventive concept are also directed to a method of compensating a spot using the above-mentioned spot compensating apparatus.

Exemplary embodiments of the present inventive concept also provide a display system having the above-mentioned spot compensating apparatus.

According to some exemplary embodiments of the present inventive concept, there is provided a spot compensating apparatus including: a spot compensation data generator configured to generate spot compensation data based on a first precision unit in a first block area having a spot, and based on a second precision unit in a second block area not having the spot, the spot compensation data being for compensating the spot displayed on a display panel configured to display an image based on first image data, the second precision unit having less precision than the first precision unit; and a spot compensator configured to perform a spot compensation on the first image data using the spot compensation data to output second image data.

In an embodiment, the spot compensation data generator is configured to generate the spot compensation data based on an N*N (N being a natural number) pixel unit in the first block area, and to generate the spot compensation data based on an M*M (M being a natural number greater than N) pixel unit in the second block area.

In an embodiment, the spot compensation data generator includes a seed data receiver configured to receive seed data for generating the spot compensation data according to an interpolation method.

In an embodiment, the spot compensation data generator includes: a first seed data extractor configured to extract the seed data based on the first precision unit; and a second seed data extractor configured to extract the seed data based on the second precision unit.

In an embodiment, the first seed data extractor is configured to extract the seed data based on an N*N (N being a natural number) pixel unit, and the second seed data extractor is configured to extract the seed data based on an M*M (M being a natural number greater than N) pixel unit.

In an embodiment, the display panel includes J*K (each of J and K being a natural number greater than 2) display blocks, and each of the J*K display blocks includes M*M pixels.

In an embodiment, the number of the display blocks is determined according to a resolution of the display panel and a ratio of the first block area in the display panel.

In an embodiment, when the resolution of the display panel is 1920*1080, the number of the display blocks is 32*18, and each of the display blocks includes 60*60 pixels.

In an embodiment, the first seed data extractor is further configured to extract the seed data based on a 4*4 pixel unit, and the second seed data extractor is further configured to extract the seed data based on a 60*60 pixel unit.

In an embodiment, the first seed data extractor is further configured to extract the seed data based on a 2*2 pixel unit, and the second seed data extractor is further configured to extract the seed data based on a 60*60 pixel unit.

In an embodiment, a seed data block for generating the spot compensation data includes J*K data blocks corresponding to the J*K display blocks, (J+1)-th additional data blocks, and (K+1)-th additional data blocks.

In an embodiment, the spot compensating apparatus of further includes: a photographing circuit configured to photograph the display panel and to output display panel data to the spot compensation data generator.

In an embodiment, the spot compensation data generator includes a first pixel position data determining circuit configured to determine whether a pixel in the display panel is in the first block area or in the second block area based on the display panel data, and to output first pixel position determination data.

In an embodiment, the display panel includes J*K (each of J and K being a natural number greater than 2) display blocks, each of J*K display blocks includes M*M (M being a natural number greater than 2) pixels, and the spot compensation data generator further includes a second pixel position data determining circuit configured to determine a position of the pixel within the display block, and to output second pixel position determination data.

According to some exemplary embodiments of the present inventive concept, there is provided a method of compensating a spot, the method including: generating spot compensation data in a first precision unit in a first block area having the spot and a second precision unit in a second block area not having the spot, the spot compensation data being for compensating the spot displayed on a display panel configured to display an image based on first image data, the second precision unit having less precision than the first precision unit; and performing a spot compensation on the first image data using the spot compensation data to output second image data.

In an embodiment, the generating the spot compensation data includes: generating the spot compensation data in an N*N (N being a natural number) pixel unit in the first block area; and generating the spot compensation data based on an M*M (M being a natural number greater than N) pixel unit in the second block area.

In an embodiment, the method further includes: receiving seed data for generating the spot compensation data according to an interpolation method, wherein the generating the spot compensation data includes: extracting the seed data based on the first precision unit; and extracting the seed data based on the second precision unit.

In an embodiment, the extracting the seed data based on the first precision unit includes extracting the seed data based on an N*N (N being a natural number) pixel unit, and the extracting the seed data based on the second precision unit includes extracting the seed data in an M*M (M being a natural number greater than N) pixel unit.

In an embodiment, the method further includes: determining whether or not a pixel in the display panel is in the first block area or in the second block area.

According to some exemplary embodiments of the present inventive concept, there is provided a display system including: a display apparatus including: a display panel configured to display an image based on first image data; a scan driver configured to output a scan signal to a scan line of the display panel; and a data driver configured to output a data signal to a data line of the display panel; and a spot compensation apparatus including: a spot compensation data generator configured to generate spot compensation data in a first precision unit in a first block area having a spot and a second precision unit in a second block area not having the spot; and a spot compensator configured to perform a spot compensation on the first image data using the spot compensation data to output second image data, the spot compensation data being for compensating the spot displayed on the display panel, the second precision unit having less precision than the first precision unit.

According to the present inventive concept, a spot compensation may be precisely performed in a block area determined as an area in which a spot is included, and a size of spot compensation data may be decreased.

BRIEF DESCRIPTION OF THE DRAWINGS

The above and other features and aspects of the present inventive concept will become more apparent by describing example embodiments thereof with reference to the accompanying drawings, in which:

FIG. 5 is a configuration diagram illustrating seed data of FIG. 3;

DETAILED DESCRIPTION

Hereinafter, the present inventive concept will be explained in detail with reference to the accompanying drawings.

Figure 1:
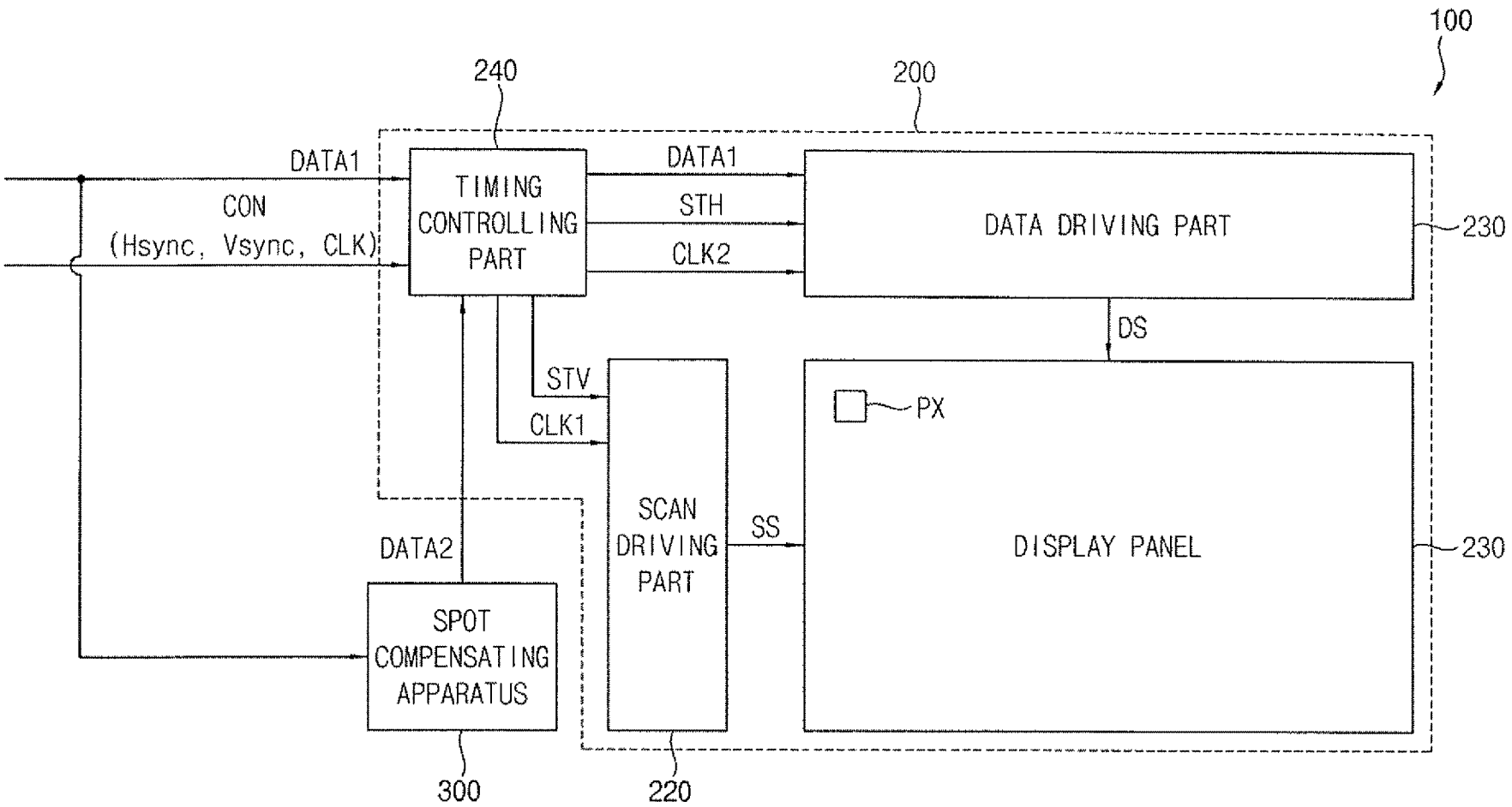
FIG. 1 is a block diagram illustrating a display system according to an exemplary embodiment of the present inventive concept.

FIG. 1 is a block diagram illustrating a display system according to an exemplary embodiment of the present inventive concept.

Referring to FIG. 1, the display system 100 according to the present exemplary embodiment includes a display apparatus 200 and a spot compensation apparatus 300.

The display apparatus includes a display panel 210, a scan driving part (e.g., a scan driver) 220, a data driving part (e.g., a data driver) 230 and a timing controlling part (e.g., a timing controller) 240.

The display panel 210 receives a data signal DS based on first image data DATA1 provided from the timing controlling part 240 to display an image. The display panel 210 includes a plurality of pixels PX. For example, the pixel PX may include a red pixel, a green pixel and a blue pixel.

Figure 2:
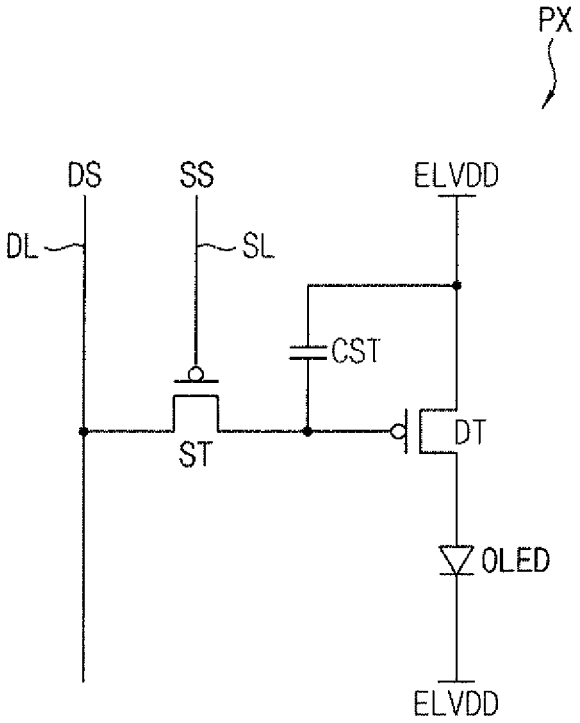
FIG. 2 is a circuit diagram illustrating a pixel.

FIG. 2 is a circuit diagram illustrating the pixel PX.

Referring to FIGS. 1 and 2, the pixel PX may include a switching transistor ST, a storage capacitor CST, a driving transistor DT and an Organic Light Emitting Diode (OLED).

The switching transistor ST may include a first electrode connected to a data line DL to receive the data signal DS, a second electrode connected to the storage capacitor CST, and a gate electrode connected to a scan line SL to receive a scan signal SS. The switching transistor ST may transmit the data signal DS provided from the data driving part 230 to the storage capacitor CST in response to the scan signal SS applied from the scan driving part 220.

The storage capacitor CST may include a first electrode connected to a terminal to which a high power voltage ELVDD is applied, and a second electrode connected to a gate electrode of the driving transistor DT. The storage capacitor CST may store a voltage of the data signal DS transmitted through the switching transistor ST.

The driving transistor DT may include a first electrode connected to the terminal to which the high power voltage ELVDD is applied, a second electrode connected to the OLED, and a gate electrode connected to the storage capacitor CST. The driving transistor DT may be turned on or turned off according to the data signal DS stored in the storage capacitor.

The OLED may include an anode electrode connected to the driving transistor DT, and a cathode electrode connected to a terminal to which low power voltage ELVSS is applied. The OLED may emit based on a current from the high power voltage ELVDD to the low power voltage ELVDD, while the driving transistor DT is turned on.

The scan driving part 220 generates the scan signal SS in response to a vertical start signal STV and a first clock signal CLK1 provided from the timing controlling part 240, and outputs the scan signal SS to the scan line SL.

The data driving part 230 outputs the data signals DS to the data line DL in response to a horizontal start signal STH and a second clock signal CLK2 provided from the timing controlling part 240.

The timing controlling part 240 receives the first image data DATA1 and a control signal CON from the outside (e.g., from an external circuit). The timing controlling part 240 may output the first image data DATA1 to the data driving part 230. The control signal CON may include a horizontal synchronous signal Hsync, a vertical synchronous signal Vsync and a clock signal CLK. The timing controlling part 240 generates the horizontal start signal STH using the horizontal synchronous signal Hsync, and outputs the horizontal start signal STH to the data driving part 230. In addition, the timing controlling part 240 generates the vertical start signal STV using the vertical synchronous signal Vsync and outputs the vertical start signal SW to the scan driving part 220. In addition, the timing controlling part 240 generates the first clock signal CLK1 and the second clock signal CLK2 using the clock signal CLK, outputs the first clock signal CLK1 to the scan driving part 220, and outputs the second clock signal CLK2 to the data driving part 230.

The spot compensating apparatus 300 compensates a spot of the image displayed on the display panel 210 and outputs second image data DATA2. Thus, the spot compensating apparatus 300 performs a spot compensation on the first image data DATA1 to output the second image data DATA2. The spot compensating apparatus 300 may output the second image data DATA2 to the timing controlling part 240. In this case, the timing controlling part 240 may output the second image data DATA2 to the data driving part 230, and the data driving part 230 may generate the data signal DS based on the second image data DATA2.

Figure 3:
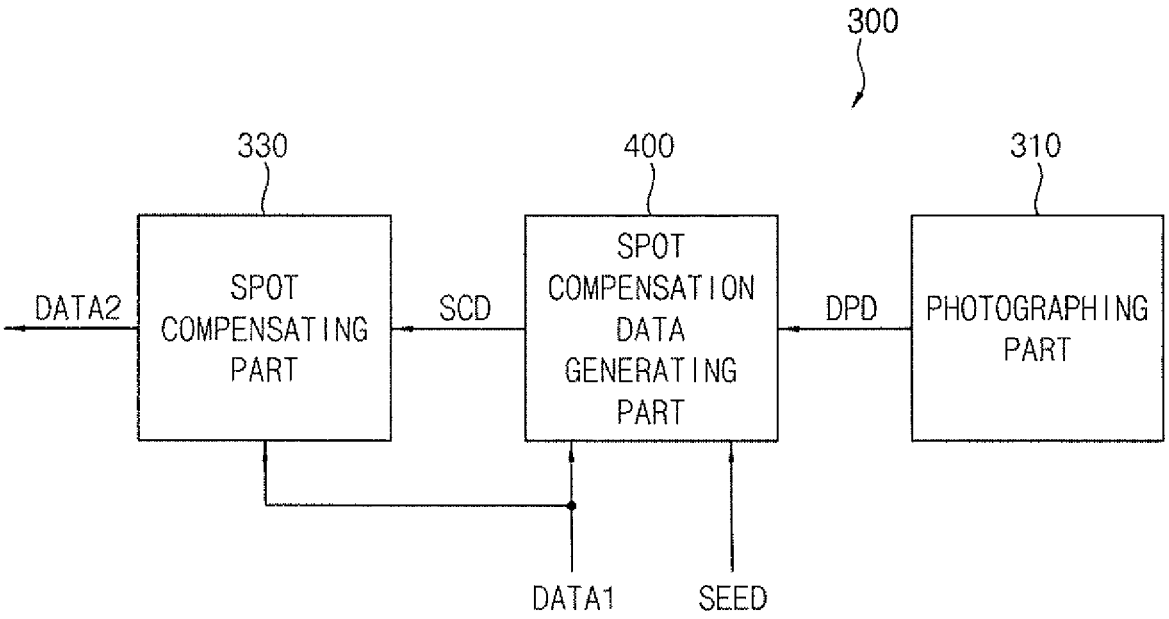
FIG. 3 is a block diagram illustrating a spot compensating apparatus of FIG. 1

FIG. 3 is a block diagram illustrating the spot compensating apparatus 300 of FIG. 1.

Referring to FIGS. 1 and 3, the spot compensating apparatus 300 includes a photographing part (e.g., a photographing circuit) 310, a spot compensation data generating part (e.g., a spot compensation data generator) 400 and a spot compensating part (e.g., a spot compensator) 330.

The photographing part 310 photographs the image displayed on the display panel 210 and outputs display panel data DPD.

Figure 4:
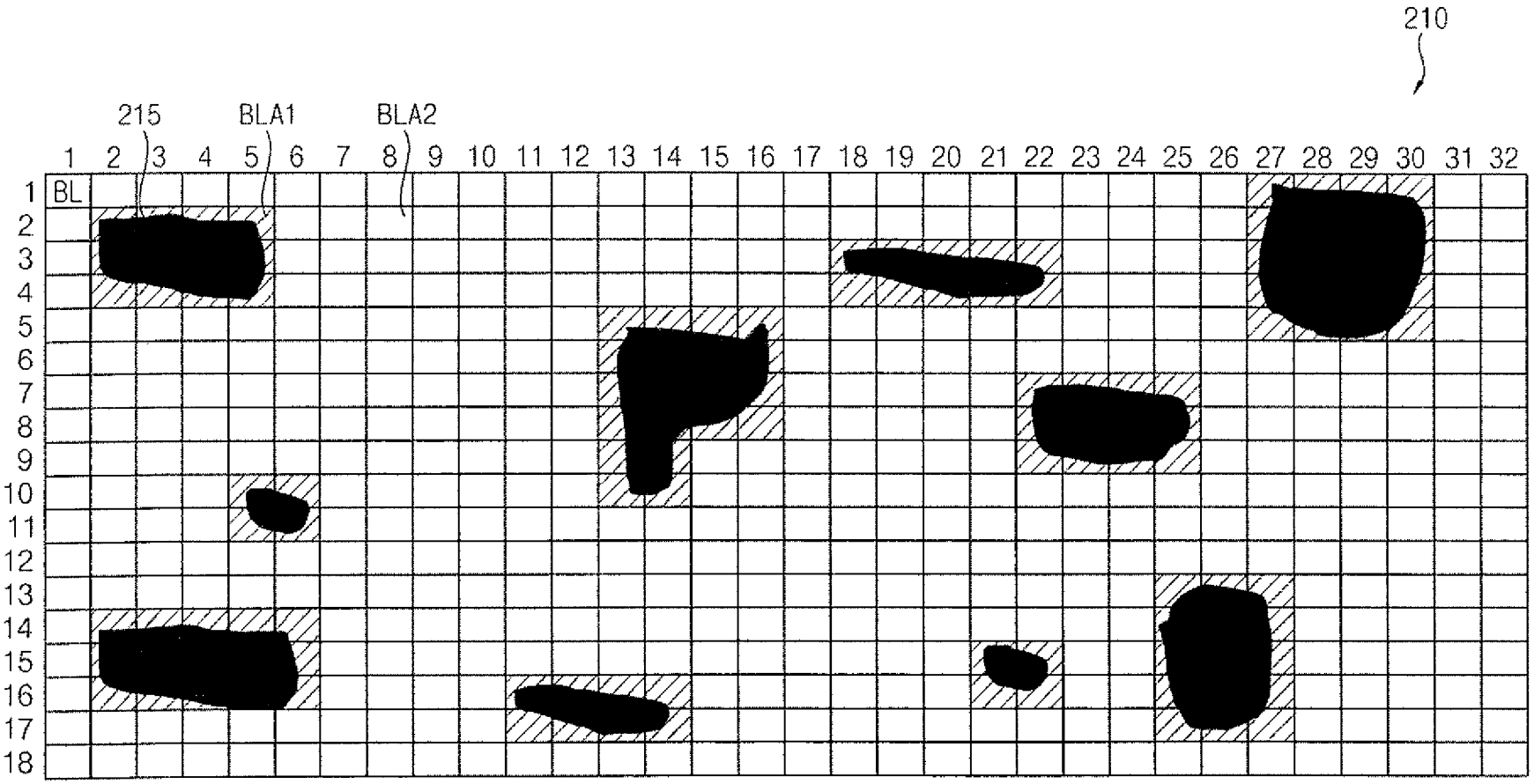
FIG. 4 is a plan view illustrating a display panel of FIG. 1 for displaying an image photographed by a photographing part of FIG. 3.

FIG. 4 is a plan view illustrating the display panel 210 of FIG. 1 displaying the image photographed by the photographing part 310 of FIG. 3.

Referring to FIGS. 1, 3 and 4, the display panel 210 may include J*K display blocks BL (where each of J and K is a natural number greater than two). For example, a resolution of the display panel 210 may be about 1920*1080, and each of the display blocks BL may include 60*60 pixels. Thus, the display panel 210 may include about 32*18 display blocks.

In addition, the display panel may include a first block area BLA1 where a spot 215 appears or is displayed, and a second block area BLA2 where the spot 215 does not appear or is not displayed.

The spot compensation data generating part 400 generates and outputs spot compensation data SCD based on the display panel data DPD, the first image data DATA1, and seed data SEED.

FIG. 5 is a configuration diagram illustrating the seed data of FIG. 3.

Referring to FIGS. 1 and 3 to 5, the seed data SEED includes J*K data blocks DBL corresponding to the display blocks BL. In addition, the seed data SEED may further include a (J+1)-th additional data block and a (K+1)-th additional data block for an interpolation. For example, in FIG. 5, data blocks DBL of a 19-th row and data blocks DBL of a 33-th row may be the additional data blocks.

In addition, the seed data SEED may include a third block area BLA3 corresponding to the first block area BLA1, and a fourth block area BLA4 corresponding to the second block area BLA2.

The following Table 1 and Table 2 illustrate the number of the pixels PX in the display block BL, the number of the data blocks DBL in a horizontal direction according to the number of the pixels PX in the display block BL, the number of the data blocks DBL in a vertical direction according to the number of the pixel PX in the display block BL, a byte size of the seed data SEED corresponding to the data block DBL, the byte size corresponding to the data blocks DBL, a byte size in case in which the spot compensation data is generated, and a byte size ratio in comparison to a reference in a case in which the spot compensation data is generated.

TABLE 1

| Block pixel | Width (ea) | Height (ea) | Seed byte | Byte size |
|---|---|---|---|---|
| 4 * 4 | 481 | 271 | 8 | 3,128,424 |
| 30 * 30 | 65 | 37 | 8 | 57,720 |
| 30 * 30 | 65 | 37 | 8 | 57,720 |
| 30 * 30 | 65 | 37 | 8 | 57,720 |
| 60 * 60 | 33 | 19 | 8 | 15,048 |
| 60 * 60 | 33 | 19 | 8 | 15,048 |
| 60 * 60 | 33 | 19 | 8 | 15,048 |
| 120 * 120 | 17 | 10 | 8 | 4,080 |
| 120 * 120 | 17 | 10 | 8 | 4,080 |
| 120 * 120 | 17 | 10 | 8 | 4,080 |

TABLE 2

| Block pixel | BLA1 Area ratio | Byte size in a case in which spot compensation data is generated in a 4 * 4 pixel unit | Byte Ratio | Byte size in a case in which spot compensation data is generated in a 2 * 2 pixel unit | Byte Ratio |
|---|---|---|---|---|---|
| 4 * 4 | | 3,128,424 | Reference | 3,128,424 | Reference |
| 30 * 30 | 10% | 376,623 | 12.0% | 1,350,648 | 43.2% |
| 30 * 30 | 20% | 695,526 | 22.2% | 2,6435,76 | 84.5% |
| 30 * 30 | 30% | 1,014,429 | 32.4% | 3,936,504 | 125.8% |
| 60 * 60 | 10% | 352,123 | 11.3% | 1,367,863 | 43.7% |
| 60 * 60 | 20% | 660,168 | 21.1% | 2,604,168 | 83.2% |
| 60 * 60 | 30% | 1,026,274 | 32.8% | 4,073,494 | 130.2% |
| 120 * 120 | 10% | 370,872 | 11.9% | 1,472,472 | 47.1% |
| 120 * 120 | 20% | 737,664 | 23.6% | 2,940,864 | 94.0% |
| 120 * 120 | 30% | 1,104,456 | 35.3% | 4,409,256 | 140.9% |

For example, when a resolution of the display panel 210 is about 1920*1080 pixels and the display block BL includes 4*4 pixels PX, the number of the data blocks DBL is about 481*271. The byte size of the seed data SEED corresponding to the data block DBL may be 8 bytes. Thus, when the pixel PX includes a red pixel, a green pixel and a blue pixel, the byte size corresponding to the data blocks DBL is about 3,128,424 (i.e., 481*271*3*8) bytes. In this case, when the spot compensation data SCD is generated for a 4*4 pixel units in all display blocks BL, the byte size for generating the spot compensation data SCD is about 3,128,424 bytes.

In addition, when the resolution of the display panel 210 is about 1920*1080 pixels and the display block BL includes about 60*60 pixels PX, the number of the data blocks DBL is about 33*19. The byte size of the seed data SEED corresponding to the data block DBL may be about 8 bytes. Thus, when the pixel PX includes the red pixel, the green pixel and the blue pixel, the byte size corresponding to the data blocks DBL is about 15048 (i.e., 33*19*3*8) bytes. For example, the area ratio of the first block area BLA1 in the display panel 210 may be about 20%. Thus, the number of the display blocks BL in the first block area BLA1 may be about 120, and the number of the display blocks BL in the second block area BLA2 may be about 507.

The spot compensation data generating part 400 may generate the spot compensation data SCD based on a first precision unit in the first block area BLA1 determined as an area in which the spot is 215 is included, and based on a second precision unit having lower precision than the first precision unit in the second block area BLA2 determined as an area in which the spot 215 is not included. For example, the spot compensation data generating part 400 may generate the spot compensation data SCD based on an N*N pixel unit in the first block area BLA1 (where N is a natural number), and may generate the spot compensation data SCD based on an M*M pixel unit in the second block area BLA2 (where M is a natural number greater than N).

For example, the spot compensation data generating part 400 may generate the spot compensation data SCD based on the 4*4 pixel unit in the first block area BLA1, and may generate the spot compensation data SCD based on a about 60*60 pixel unit in the second block area BLA2. In this case, the byte size required in generating the spot compensation data SCD is about 660,168 (i.e., (15*15*3*8*120)+(1*1*3*8*507)) bytes. Thus, the spot compensation data generating part 400 may decrease a size of the spot compensation data SCD as compared to a case in which the spot compensation data SCD is generated based on the 4*4 pixel unit in ail display blocks BL.

In addition, the spot compensation data generating part 400 may generate the spot compensation data SCD based on a 2*2 pixel unit in the first block area BLA1, and may generate the spot compensation data SCD based on a 60*60 pixel unit in the second block area BLA2. In this case, the byte size required in generating the spot compensation data SCD is about 2,204,168 (i.e., (30*30*3*8*120)+(1*1*3*8*507)) bytes. Thus, the spot compensation data generating part 400 may perform the spot compensation more precisely and may decrease the size of the spot compensation data SCD as compared to the case in which the spot compensation data SCD is generated in a 4*4 pixel unit in all display blocks BL.

Here, the number of the display blocks BL may be determined in consideration of the resolution of the display panel 210, and the area ratio of the first block area BLA1 in the display panel 210.

The spot compensating part 330 performs the spot compensation on the first image data DATA1 based on the spot compensation data SCD, and outputs the second image data DATA2.

Figure 6:
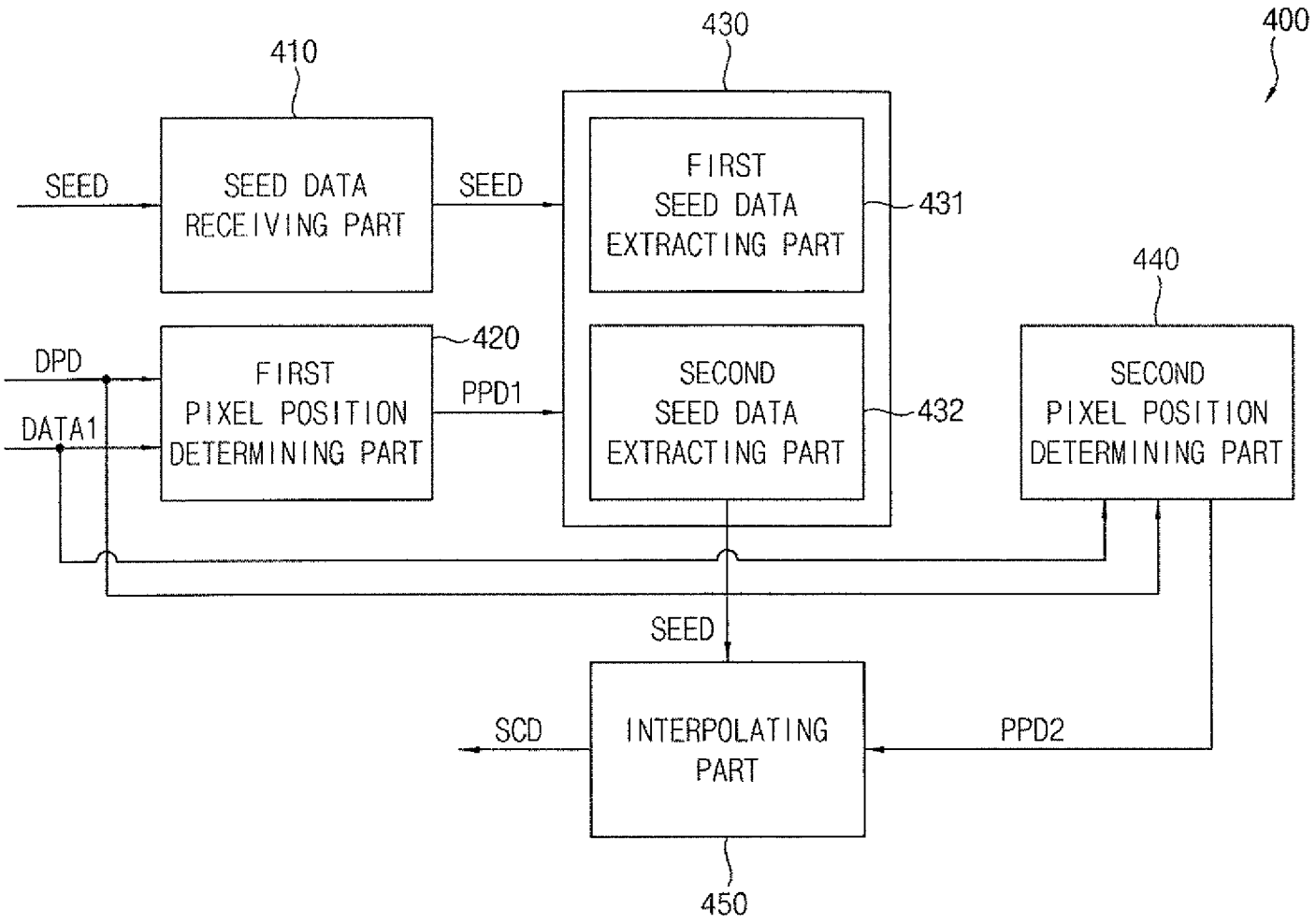
FIG. 6 is a block diagram illustrating a spot compensation data generating part of FIG. 3.

FIG. 6 is a block diagram illustrating the spot compensation data generating part 400 of FIG. 3.

Referring to FIGS. 1 and 3 to 6, the spot compensation data generating part 400 includes a seed data receiving part (e.g., a seed data receiver) 410, a first pixel position determining part (e.g., a first pixel position determining circuit) 420, a seed data extracting part (e.g., a seed data extractor) 430, a second pixel position determining part (e.g., a second pixel position determining circuit) 440 and an interpolating part (e.g., an interpolator) 450.

The seed data receiving part 410 receives the seed data SEED from the outside (e.g., from an external circuit). The seed data receiving part 410 may include a memory for storing the seed data SEED.

The following Table 3 illustrates a map of the memory for storing the seed data SEED.

TABLE 3

| | Start address | End address |
|---|---|---|
| Index | 0 | 239 |
| BLA3, DBL #0 | 240 | 21,839 |
| BLA3, DBL #1 | 21,840 | 43,439 |
| . . . | . . . | . . . |
| BLA3, DBL #118 | 2,549,040 | 2,570,639 |
| BLA3, DBL #119 | 2,570,640 | 2,592,239 |
| BLA4, DBL #0 | 2,592,240 | 2,592,263 |
| BLA4, DBL #1 | 2,592,264 | 2,592,287 |
| . . . | . . . | . . . |
| BLA4, DBL #505 | 2,604,360 | 2,604,383 |
| BLA4, DBL #506 | 2,604,384 | 2,604,407 |

For example, the resolution of the display panel 210 may be about 1920*1080 pixels, the display block BL may include about 60*60 pixels PX, the number of the display blocks BL in the first block area BLA1 may be about 120, and the number of the display blocks BL in the second block area BLA2 may be about 507. In addition, the spot compensation data generating part 400 may generate the spot compensation data SCD in about 2*2 pixel unit, and may generate the spot compensation data SCD in about 60*60 pixel unit.

In this case, index data indicating the display block BL in the first block area BLA1 may have about 240 bytes. Each data blocks DBL included in the third block area BLA3 corresponding to the first block area BLA1 may have about 21,600 (i.e., 30*30*3*8) bytes. Each data blocks DBL included in the fourth block area BLA4 corresponding to the second block area BLA2 may have about 24 (i.e., 1*1*3*8) bytes.

The first pixel position data determining part 420 receives the first image data DATA1 and the display panel data DPD, determines whether or not the pixel PX is included in the first block area BLA1 or the second block area BLA2 based on the first image data DATA1 and the display panel data DPD, and outputs first pixel position data PPD1. The first pixel position data PPD1 may indicate whether or not the pixel PX is included in the first block area BLA1 or the second block area BLA2.

The seed data extracting part 430 includes a first seed data extracting part (e.g., a first seed data extractor) 431 and a second seed data extracting part (e.g., a second seed data extractor) 432. The seed data extracting part 430 receives the seed data SEED from the seed data receiving part 410 and receives the first pixel position data PPD1 from the first pixel position determining part 420. When the pixel PX is included in the first block area BLA1, the first seed data extracting part 431 of the seed data extracting part 430 extracts and outputs the seed data SEED in the N*N pixel unit. In addition, when the pixel PX is included in the second block area BLA2, the second seed data extracting part 432 of the seed data extracting part 430 extracts and outputs the seed data SEED in the M*M pixel unit.

For example, the first seed data extracting part 431 may extract the seed data SEED in about 4*4 pixel unit.

Figure 7:
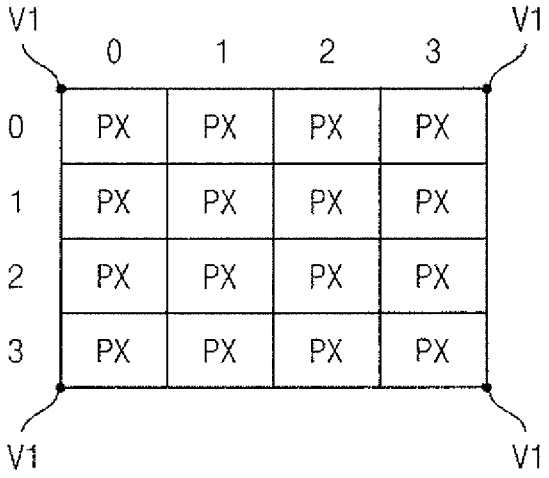
FIG. 7 is a plan view illustrating 4*4 pixels.

FIG. 7 is a plan view illustrating 4*4 pixels PX.

Referring to FIGS. 6 and 7, the seed data SEED may include a spot compensation value obtained from a model establishing a relationship between a voltage and a luminance at vertices V1 of 4*4 pixels PX.

Alternatively, the first seed data extracting part 431 may extract the seed data SEED in 2*2 pixel unit.

Figure 8:
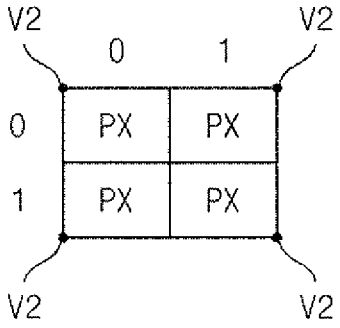
FIG. 8 is a plan view illustrating 2*2 pixels.

FIG. 8 is a plan view illustrating 2*2 pixels PX.

Referring to FIGS. 6 and 8, the seed data SEED may include a spot compensation value obtained from a model establishing a relationship between a voltage and a luminance at vertices V2 of 2*2 pixels PX.

In addition, for example, the second seed data extracting part 432 may extract the seed data SEED in 60*60 pixel unit.

Figure 9:
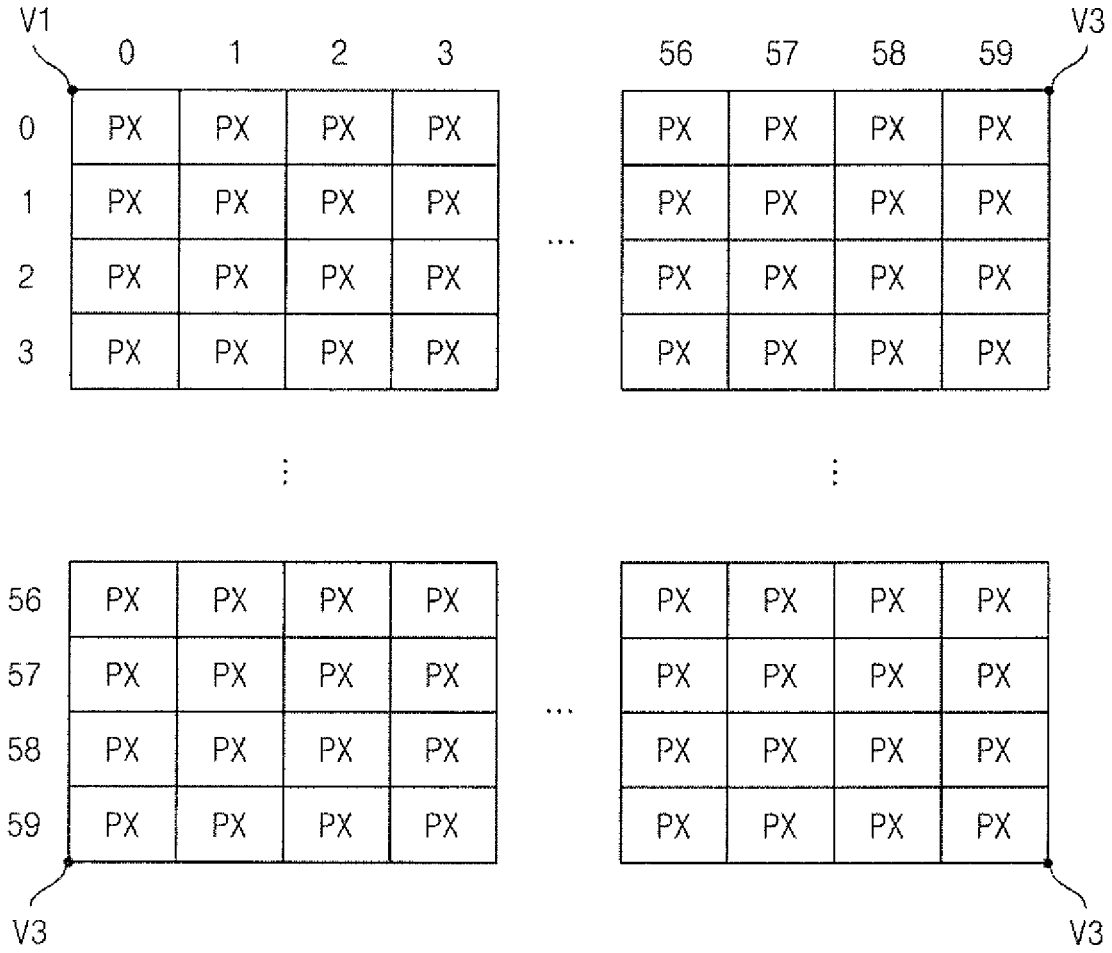
FIG. 9 is a plan view illustrating 60*60 pixels.

FIG. 9 is a plan view illustrating 60*60 pixels PX.

Referring to FIGS. 6 and 9, the seed data SEED may include a spot compensation value obtained from a model establishing a relationship between a voltage and a luminance at vertices V3 of the 60*60 pixels PX.

Referring to FIGS. 1 and 3 to 6 again, the second pixel position determining part 440 determines the position of the pixel PX in the display block BL based on the first image data DATA1 and the display panel data DPD, and outputs second pixel position data PPD2.

Figure 10:
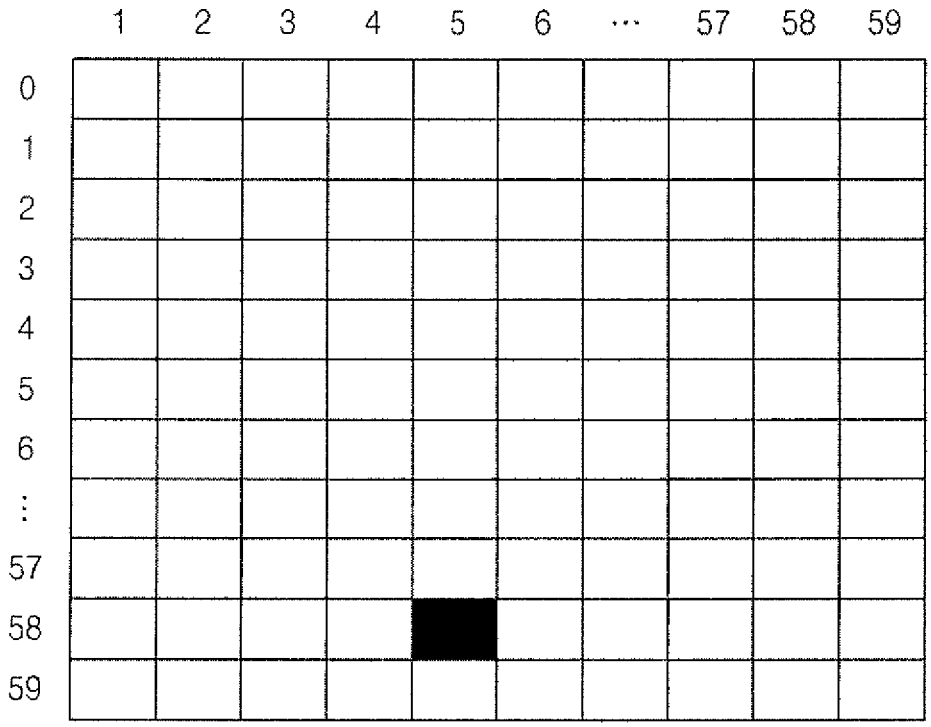
FIG. 10 is a plan view illustrating a display block of FIG. 4.

FIG. 10 is a plan view illustrating the display block BL of FIG. 4.

Referring to FIGS. 1, 3 to 6 and 10, when the display block BL includes 60*60 pixels PX and coordinates of the pixel PX in the display panel 210 is (126, 539), coordinates of the display block BL shown in FIG. 4 is (2, 9) and coordinates of the pixel PX in the display block BL is (5, 58).

Referring to FIGS. 1 and 3 to 6 again, the interpolating part receives the seed data SEED from the seed data extracting part 430 and receives the second pixel position data PPD2 from the second pixel determining part 440. The interpolating part 450 generates and outputs the spot compensation data SCD according to an interpolation method using the seed data SEED and based on the second pixel position data PPD2.

Figure 11:
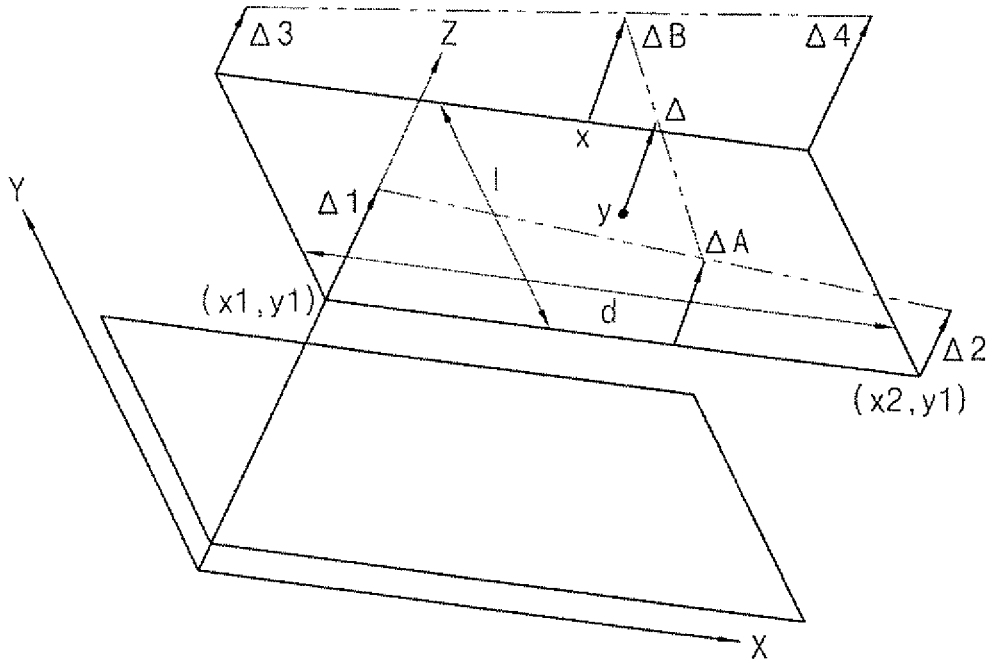
FIG. 11 is a graph for calculating spot compensation data generated by an interpolating part of FIG. 6.

FIG. 11 is a graph for calculating the spot compensation data SCD generated by the interpolating part 450 of FIG. 6.

Referring to FIG. 11, in a A*A pixel block, spot compensation data of a pixel of which coordinates is (x, y) may be calculated by the following Equation 1, Equation 2 and Equation 3.

$$\Delta A=(\Delta 1-\Delta 2)/d)*(x2-x)+\Delta 2 \quad \text{[Equation 1]}$$

$$\Delta B=(\Delta 4-\Delta 3)/d)*(x-x1)+\Delta 3 \quad \text{[Equation 2]}$$

$$\Delta=(\Delta B-\Delta A)/I)*(y-y1)+\Delta A \quad \text{[Equation 3]}$$

Here, "Δ1" is an offset value at a lower left point of the A*A pixel block of the seed data referred by (e.g., associated with) the pixel, "Δ2" is an offset value at a lower right point of the A*A pixel block of the seed data referred by (e.g., associated with) the pixel, "Δ3" is an offset value at an upper left point of the A*A pixel block of the seed data referred by (e.g., associated with) the pixel, and "Δ4" is an offset value at an upper right point of the A*A pixel block of the seed data referred by (e.g., associated with) the pixel. In addition, "ΔA" is an interpolation offset value at a bottom using "Δ1", "Δ2" and an x coordinate of the pixel in the A*A pixel block, "ΔB" is an interpolation offset value at a top using "Δ3", "Δ4" and the x coordinate of the pixel in the A*A pixel block, and "Δ" is spot compensation data of the pixel. In addition, "x" is the x coordinate of the pixel in the A*A pixel block, "y" is a y coordinate of the pixel in the A*A pixel block, "x1" is an x coordinate of the lower left point of the A*A pixel block, "y1" is a y coordinate of the lower left point of the A*A pixel block, "x2" is an x coordinate of the lower right point of the A*A pixel block, "y2" is a y coordinate of the lower right point of the A*A pixel block, "d" is a length of an x axis direction in the A*A pixel block, and "I" is a height of a y axis direction in the A*A pixel block.

Figure 12:
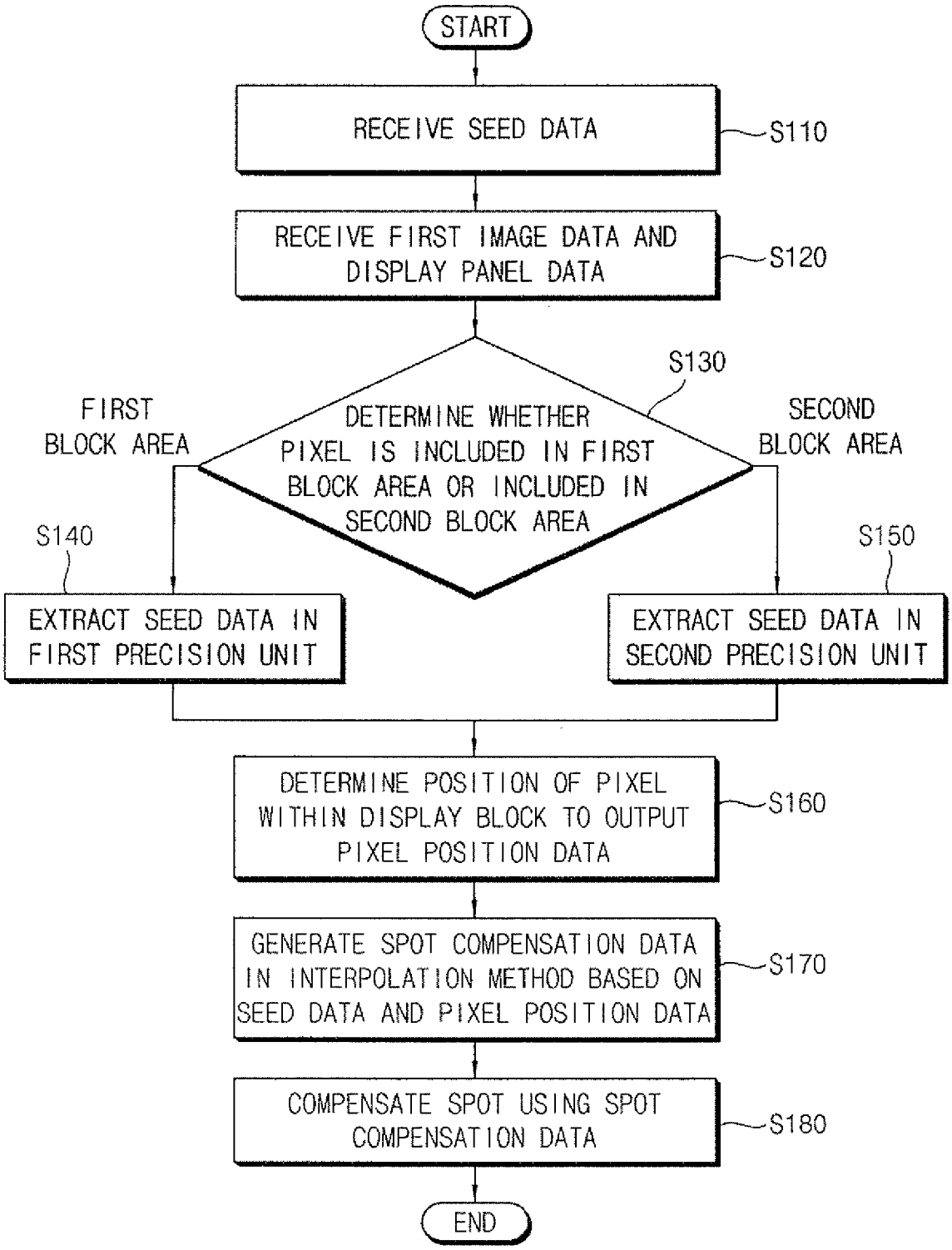
FIG. 12 is a flow diagram illustrating a method of compensating a spot using the spot compensating apparatus of FIG. 1.

FIG. 12 is a flow diagram illustrating a method of compensating a spot using the spot compensating apparatus 300 of FIG. 1.

Referring to FIGS. 1 and 3 to 12, the seed data SEED is received (block S110). For example, the seed data receiving part 410 receives the seed data SEED from the outside (e.g., from an external circuit). The seed data receiving part 410 may include the memory storing the seed data SEED.

The first image data DATA1 and the display panel data DPD are received (block S120). For example, the first pixel position data determining part 420 receives the first image data DATA1 and the display panel data DPD.

The pixel PX is determined whether or not the pixel PX is included in the first block area BLA1 or the second block area BLA2 (block S130). For example, the first pixel position data determining part 420 determines whether or not the pixel PX is included in the first block area BLA1 or the second block area BLA2 based on the first image data DATA1 and the display panel data DPD, and outputs first pixel position data PPD1. The first pixel position data PPD1 may indicate whether or not the pixel PX is included in the first block area BLA1 or the second block area BLA2.

When the pixel PX is included in the first block area BLA1, the seed data SEED is extracted based on the first precision unit (block S140). That is, when the pixel PX is included in the first block area BLA1, the first seed data extracting part 431 of the seed data extracting part 430 extracts and outputs the seed data SEED in the N*N pixel unit. For example, the first seed data extracting part 431 may extract the seed data SEED in 4*4 pixel unit. Alternatively, the first seed data extracting part 431 may extract the seed data SEED in 2*2 pixel unit.

When the pixel PX is included in the second block area BLA2, the seed data SEED is extracted based on the second precision unit (block S150). That is, when the pixel PX is included in the second block area BLA2, the second seed data extracting part 432 of the seed data extracting part 430 extracts and outputs the seed data SEED in the M*M pixel unit. For example, the second seed data extracting part 432 may extract the seed data SEED in 60*60 pixel unit.

The position of the pixel PX in the display block BL is determined, and the second pixel position data PPD2 is output (block S160). For example, the second pixel position determining part 440 determines the position of the pixel PX in the display block BL based on the first image data DATA1 and the display panel data DPD, and outputs the second pixel position data PPD2.

The spot compensation data SCD is generated according to the interpolation method based on the seed data SEED and the second pixel position data PPD2 (block S170). For example, the interpolating part 450 receives the seed data SEED from the seed data extracting part 430 and receives the second pixel position data PPD2 from the second pixel determining part 440. The interpolating part 450 generates and outputs the spot compensation data SCD according to the interpolation method using the seed data SEED and based on the second pixel position data PPD2.

The spot 215 is compensated using the spot compensation data SCD (block S180). For example, the spot compensating part 330 performs the spot compensation on the first image data DATA1 based on the spot compensation data SCD, and outputs the second image data DATA2.

According to the present exemplary embodiment, when the pixel PX is included in the first block area BLA1 determined as the area in which the spot 215 is included, the spot compensating apparatus 300 generates the spot compensation data SCD based on the first precision unit, and when the pixel PX is included in the second block area BLA2 determined as the area in which the spot 215 is not included, the spot compensating apparatus 300 generates the spot compensation data SCD based on the second precision unit less than the first precision unit. Thus, the spot compensation may be comparatively precisely performed in the first block area BLA1 determined as the area in which the spot 215 is included, and the size of the spot compensation data SCD may be decreased.

According to a spot compensating apparatus, a method of compensating a spot using the spot compensating apparatus, and a display system having the spot compensating apparatus, a spot compensation may be precisely performed in a block area determined as an area in which a spot is included, and a size of spot compensation data may be decreased.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

Spatially relative terms, such as "beneath", "below", "lower", "under", "above", "upper" and the like, may be used herein for ease of description to describe one element or feature's relationship to another element(s) or feature(s) as illustrated in the figures. It will be understood that the spatially relative terms are intended to encompass different orientations of the device in use or in operation, in addition to the orientation depicted in the figures.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Further, the use of "may" when describing embodiments of the inventive concept refers to "one or more embodiments of the inventive concept." Also, the term "exemplary" is intended to refer to an example or illustration.

It will be understood that when an element or layer is referred to as being "on", "connected to", or "coupled to" another element or layer, it can be directly on, connected to, or coupled to, the other element or layer, or one or more intervening elements or layers may be present. When an element or layer is referred to as being "directly on," "directly connected to", or "directly coupled to" another element or layer, there are no intervening elements or layers present.

As used herein, the term "substantially," "about," and similar terms are used as terms of approximation and not as terms of degree, and are intended to account for the inherent variations in measured or calculated values that would be recognized by those of ordinary skill in the art.

As used herein, the terms "use," "using," and "used" may be considered synonymous with the terms "utilize," "utilizing," and "utilized," respectively.

The display system and/or any other relevant devices or components according to embodiments of the present invention described herein, such as the display apparatus and the spot compensating apparatus, may be implemented utilizing any suitable hardware, firmware (e.g. an application-specific integrated circuit), software, or a suitable combination of software, firmware, and hardware. For example, the various components of the display system may be formed on one integrated circuit (IC) chip or on separate IC chips. Further, the various components of the display system may be implemented on a flexible printed circuit film, a tape carrier package (TCP), a printed circuit board (PCB), or formed on a same substrate. Further, the various components of the display system may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

The foregoing is illustrative of the present inventive concept and is not to be construed as limiting thereof. Although a few exemplary embodiments of the present inventive concept have been described, those skilled in the art will readily appreciate that many suitable modifications are possible in the exemplary embodiments without materially departing from the novel teachings and aspects of the present inventive concept. Accordingly, all such modifications are intended to be included within the scope of the present inventive concept as defined by the claims and equivalents thereof. In the claims, means-plus-function clauses are intended to cover the structures described herein as performing the recited function and also equivalent structures.

What is claimed is:

1. A spot compensating apparatus comprising:

a spot compensation data generator configured to generate spot compensation data based on a first precision unit in a first block area having a spot, and based on a second precision unit in a second block area not having the spot, the spot compensation data being for compensating the spot displayed on a display panel configured to display an image based on first image data, the first precision unit being N*N (N being a natural number) pixels, and the second precision unit being M*M (M being a natural number greater than N) pixels;

a spot compensator configured to perform a spot compensation on the first image data using the spot compensation data to output second image data; and a photographing circuit configured to photograph the display panel and to output display panel data to the spot compensation data generator, wherein the spot compensation data generator comprises a seed data receiver configured to receive seed data for generating the spot compensation data according to an interpolation method, wherein the spot compensation data generator is configured to generate a first spot compensation data of a first pixel in the first block area based on first seed data of the seed data and a second spot compensation data of a second pixel in the second block area based on second seed data of the seed data, each of the first seed data and the second seed data comprising a spot compensation value based on a relationship between a voltage and a luminance at vertices of the first precision unit and the second precision unit, respectively, and wherein the spot compensation data generator comprises a first pixel position data determining circuit configured to determine whether a pixel in the display panel is in the first block area or in the second block area based on the display panel data, and to output first pixel position determination data.

2. The spot compensating apparatus of claim 1, wherein the spot compensation data generator further comprises:

a first seed data extractor configured to extract the first seed data based on the first precision unit; and a second seed data extractor configured to extract the second seed data based on the second precision unit.

3. The spot compensating apparatus of claim 2, wherein the first seed data extractor is configured to extract the first seed data based on an N*N (N being a natural number) pixel unit, and the second seed data extractor is configured to extract the second seed data based on an M*M (M being a natural number greater than N) pixel unit.

4. The spot compensating apparatus of claim 3, wherein the display panel comprises J*K (each of J and K being a natural number greater than 2) display blocks, and each of the J*K display blocks comprises M*M pixels.

5. The spot compensating apparatus of claim 4, wherein a number of the display blocks is determined according to a resolution of the display panel and a ratio of the first block area in the display panel.

6. The spot compensating apparatus of claim 5, wherein, when the resolution of the display panel is 1920*1080, the number of the display blocks is 32*18, and each of the display blocks comprises 60*60 pixels.

7. The spot compensating apparatus of claim 6, wherein the first seed data extractor is further configured to extract the first seed data based on a 4*4 pixel unit, and the second seed data extractor is further configured to extract the second seed data based on a 60*60 pixel unit.

8. The spot compensating apparatus of claim 6, wherein the first seed data extractor is further configured to extract the first seed data based on a 2*2 pixel unit, and the second seed data extractor is further configured to extract the second seed data based on a 60*60 pixel unit.

9. The spot compensating apparatus of claim 4, wherein a seed data block for generating the spot compensation data comprises J*K data blocks corresponding to the J*K display blocks, (J+1)-th additional data blocks, and (K+1)-th additional data blocks.

10. The spot compensating apparatus of claim 1, wherein the display panel comprises J*K (each of J and K being a natural number greater than 2) display blocks, each of the J*K display blocks comprises M*M (M being a natural number greater than 2) pixels, and wherein the spot compensation data generator further comprises a second pixel position data determining circuit configured to determine a position of the pixel within one of the J*K display blocks, and to output second pixel position determination data.

11. The spot compensating apparatus of claim 1, wherein the spot compensation data generator is configured to generate the spot compensation data based on an N*N pixel unit in the first block area, and to generate the spot compensation data based on an M*M pixel unit in the second block area.

12. The spot compensating apparatus of claim 1, wherein the seed data receiver is configured to receive the seed data from an external circuit.

13. A method of compensating a spot, the method comprising:

photographing a display panel and outputting display panel data;

receiving seed data for generating spot compensation data according to an interpolation method, the seed data comprising first seed data and second seed data, each of the first seed data and the second seed data comprising a spot compensation value based on a relationship between a voltage and a luminance at vertices of a first precision unit in a first block area having the spot and a second precision unit in a second block area not having the spot, respectively;

determining whether or not a pixel in the display panel is in the first block area or in the second block area based on the display panel data, and outputting first pixel position determination data;

generating the spot compensation data in the first precision unit and the second precision unit, the generating the spot compensation data comprising generating a first spot compensation data of a first pixel in the first block area based on the first seed data and generating a second spot compensation data of a second pixel in the second block area based on the second seed data, the spot compensation data being for compensating the spot displayed on a display panel configured to display an image based on first image data, the first precision unit being N*N (N being a natural number) pixels, and the second precision unit being M*M (M being a natural number greater than N) pixels; and performing a spot compensation on the first image data using the spot compensation data to output second image data.

14. The method of claim 13, wherein the generating the spot compensation data comprises:

extracting the first seed data based on the first precision unit; and extracting the second seed data based on the second precision unit.

15. The method of claim 14, wherein the extracting the first seed data based on the first precision unit comprises extracting the first seed data based on an N*N (N being a natural number) pixel unit, and the extracting the second seed data based on the second precision unit comprises extracting the second seed data in an M*M (M being a natural number greater than N) pixel unit.

16. The method of claim 13, wherein the generating the spot compensation data comprises:

generating the spot compensation data in an N*N pixel unit in the first block area; and generating the spot compensation data based on an M*M pixel unit in the second block area.

17. The method of claim 13, wherein the seed data is received from an external circuit.

18. A display system comprising:

a display apparatus comprising:

a display panel configured to display an image based on first image data;

a scan driver configured to output a scan signal to a scan line of the display panel; and a data driver configured to output a data signal to a data line of the display panel; and a spot compensation apparatus comprising:

a spot compensation data generator configured to generate spot compensation data in a first precision unit in a first block area having a spot and a second precision unit in a second block area not having the spot;

a spot compensator configured to perform a spot compensation on the first image data using the spot compensation data to output second image data, the spot compensation data being for compensating the spot displayed on the display panel, the first precision unit being N*N (N being a natural number) pixels, and the second precision unit being M*M (M being a natural number greater than N) pixels; and a photographing circuit configured to photograph the display panel and to output display panel data to the spot compensation data generator, the spot compensation data generator comprises a seed data receiver configured to receive seed data for generating the spot compensation data according to an interpolation method, wherein the spot compensation data generator is configured to generate a first spot compensation data of a first pixel in the first block area based on first seed data of the seed data and a second spot compensation data of a second pixel in the second block area based on second seed data of the seed data, each of the first seed data and the second seed data comprising a spot compensation value based on a relationship between a voltage and a luminance at vertices of the first precision unit and the second precision unit, respectively, and wherein the spot compensation data generator comprises a first pixel position data determining circuit configured to determine whether a pixel in the display panel is in the first block area or in the second block area based on the display panel data, and to output first pixel position determination data.

19. The display system of claim 18, wherein the spot compensation data generator is configured to generate the spot compensation data based on an N*N pixel unit in the first block area, and to generate the spot compensation data based on an M*M pixel unit in the second block area.

20. The display system of claim 18, wherein the seed data receiver is configured to receive the seed data from an external circuit.

* * * * *